US009239545B2

(12) United States Patent
Morishita

(10) Patent No.: US 9,239,545 B2
(45) **Date of Patent: *Jan. 19, 2016**

(54) TONER CONVEYING DEVICE, IMAGE FORMING APPARATUS

(71) Applicant: KYOCERA Document Solutions Inc., Osaka-shi, Osaka (JP)

(72) Inventor: Hiroki Morishita, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/572,657

(22) Filed: Dec. 16, 2014

(65) Prior Publication Data

US 2015/0177648 A1 Jun. 25, 2015

(30) Foreign Application Priority Data

Dec. 20, 2013 (JP) ..... 2013-264375

(51) Int. Cl.
*G03G 15/08* (2006.01)
*G03G 21/10* (2006.01)

(52) U.S. Cl.
CPC ..... *G03G 15/0886* (2013.01); *G03G 21/105* (2013.01)

(58) Field of Classification Search
CPC .. G03G 15/0886; G03G 21/105; G03G 21/10
See application file for complete search history.

(56) References Cited

U.S. PATENT DOCUMENTS

| | | | | |
|---|---|---|---|---|
| 6,266,511 | B1 * | 7/2001 | Murakami et al. | 399/358 |
| 2006/0104663 | A1 | 5/2006 | Kitozaki | |
| 2011/0158723 | A1 * | 6/2011 | Yokokawa | 399/358 |
| 2011/0229209 | A1 * | 9/2011 | Takaya et al. | 399/257 |
| 2014/0321896 | A1 * | 10/2014 | Morishita | 399/358 |
| 2015/0030355 | A1 | 1/2015 | Eto et al. | |

FOREIGN PATENT DOCUMENTS

| | | | |
|---|---|---|---|
| EP | 1659456 | A2 | 5/2006 |
| EP | 2811344 | A1 | 12/2014 |
| JP | 09146432 | A | 6/1997 |
| JP | 2010256741 | A | 11/2010 |

OTHER PUBLICATIONS

European Patent Office, Extended European Search Report Issued in Application No. 14197814.1, May 4, 2015, Germany, 6 pages.

* cited by examiner

*Primary Examiner* — Rodney Bonnette

(74) *Attorney, Agent, or Firm* — Alleman Hall McCoy Russell & Tuttle LLP

(57) ABSTRACT

Toner conveying device includes cylindrical member, shutter member, and shutter opening/closing mechanism. Cylindrical member is provided at end of toner conveyance path in which toner is conveyed, cylindrical member having first opening from which toner is discharged, end of toner conveyance path being on downstream side in toner conveyance direction. Shutter member is formed in shape of cylinder with bottom and configured to be externally fitted with cylindrical member and open and close first opening. Shutter opening/closing mechanism is configured to cause shutter member to pivot between open position at which first opening is opened and closed position at which first opening is closed, while moving shutter member in direction along axis around which shutter member pivots such that at closed position, bottom surface of shutter member and side edge of cylindrical member are pressed against each other.

5 Claims, 16 Drawing Sheets

TONER CONVEYING DEVICE, IMAGE FORMING APPARATUS

INCORPORATION BY REFERENCE

This application is based upon and claims the benefit of priority from the corresponding Japanese Patent Application No. 2013-264375 filed on Dec. 20, 2013, the entire contents of which are incorporated herein by reference.

BACKGROUND

The present disclosure relates to a toner conveying device for conveying toner, and an image forming apparatus.

Generally, in an electrophotographic image forming apparatus such as a copier, printer or facsimile, an electrostatic latent image formed on an image carrier such as a photoconductor drum is visualized with developer (toner) in a developing device, and the toner image is transferred to a recording medium. In this process, toner that has not been transferred to the recording medium may remain on the surface of the photoconductor drum. As a result, a cleaning device removes the remaining toner (waste toner) from the surface of the photoconductor drum. The toner removed from the surface of the photoconductor drum is conveyed by a screw as the waste toner, and then recovered in a waste bottle.

Meanwhile, the photoconductor drum, cleaning blade and the like have shorter lives than the image forming apparatus. As a result, these parts are normally provided as a unit that can be installed in the apparatus main body in an attachable/detachable manner as a replacement part (hereinafter, the unit is referred to as "cleaning unit"). In that case, an opening is formed in the cleaning unit to allow a waste toner conveyance path in the cleaning unit to communicate with the waste bottle.

The cleaning unit is attached to and detached from the apparatus main body. As a result, when the cleaning unit is detached from the apparatus main body, it is necessary to prevent the waste toner remaining in the cleaning unit from leaking from the opening.

There is known a conventional technology in which a shutter member is provided to open and close the opening. Specifically, an end of a casing of the cleaning unit on the downstream side in the conveyance path is formed in a shape of a cylinder, and the above-mentioned opening is formed in a lower part of the cylindrical portion. On the other hand, the shutter member is formed in the shape of a cup to be externally fitted with the cylindrical portion, and has an opening of a shape corresponding to the opening of the casing. In addition, the shutter member is configured to be rotated in the circumferential direction between a closing position and an opening position, wherein at the closing position, the opening of the casing is closed by the shutter member, and at the opening position, the opening of the casing overlaps with the opening of the shutter member, and the waste toner conveyance path in the cleaning unit is communicated with the waste bottle.

SUMMARY

A toner conveying device according to an aspect of the present disclosure includes a cylindrical member, a shutter member, and a shutter opening/closing mechanism. The cylindrical member is provided at an end of a toner conveyance path in which toner is conveyed, the cylindrical member having a first opening from which the toner is discharged, the end of the toner conveyance path being on a downstream side in a toner conveyance direction. The shutter member is formed in a shape of a cylinder with a bottom and configured to be externally fitted with the cylindrical member and open and close the first opening. The shutter opening/closing mechanism is configured to cause the shutter member to pivot between an open position at which the first opening is opened and a closed position at which the first opening is closed, while moving the shutter member in a direction along an axis around which the shutter member pivots such that at the closed position, a bottom surface of the shutter member and a side edge of the cylindrical member are pressed against each other.

An image forming apparatus according to another aspect of the present disclosure includes a cleaning member, a cylindrical member, a shutter member, and a shutter opening/closing mechanism. The cleaning member is configured to remove toner from a surface of a photoconductor drum that carries a toner image. The cylindrical member is provided at a downstream-side end of a waste toner conveyance path in which waste toner removed by the cleaning member is conveyed, and has a first opening from which the waste toner is discharged, the downstream-side end being on a downstream side in a waste toner conveyance direction of the waste toner conveyance path. The shutter member is formed in a shape of a cylinder with a bottom and configured to be externally fitted with the cylindrical member and open and close the first opening. The shutter opening/closing mechanism is configured to cause the shutter member to pivot between an open position at which the first opening is opened and a closed position at which the first opening is closed, while moving the shutter member in a direction along an axis around which the shutter member pivots such that at the closed position, a bottom surface of the shutter member and a side edge of the cylindrical member are pressed against each other.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
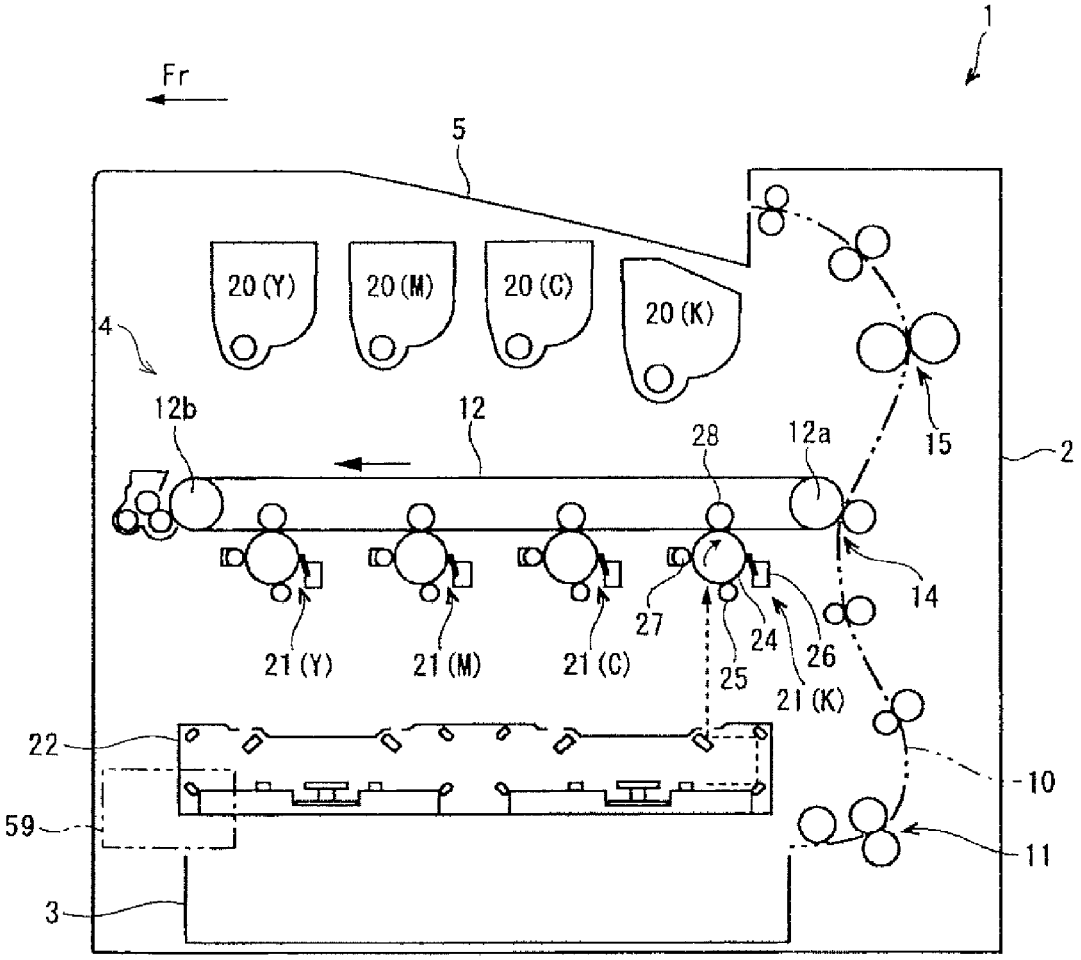
FIG. 1 is a schematic cross sectional view showing the internal configuration of the image forming apparatus in an embodiment of the present disclosure.

The following describes embodiments of the present disclosure with reference to the drawings. It should be noted that the following embodiments are only examples of specific embodiments of the present disclosure and should not limit the technical scope of the present disclosure. An image forming apparatus 1 shown in FIG. 1 is an example of the image forming apparatus of the present disclosure. In the following description, a front direction Fr shown in FIG. 1 may be used for explanation.

As shown in FIG. 1, the image forming apparatus 1 is a multifunction peripheral having functions of a printer, a facsimile and the like. The image forming apparatus 1 prints an input image onto a print sheet by using a print material such as toner. It is noted that the image forming apparatus 1 is not limited to a multifunction peripheral, but may be an apparatus such as a printer, facsimile, or copier.

As shown in FIG. 1, the image forming apparatus 1 includes an apparatus main body 2, a sheet feed cassette 3, a sheet discharge tray 5, a sheet feed portion 11, an intermediate transfer unit 4, an image forming portion 21, a secondary transfer portion 14, and a fixing portion 15.

The sheet feed cassette 3 is provided in a lower part of the apparatus main body 2, and configured to store a plurality of print sheets in a stacked state. The sheet discharge tray 5 is provided on an upper surface of the apparatus main body 2. The sheet feed portion 11 supplies, one by one, the print sheets set in the sheet feed cassette 3 to a conveyance path 10. The image forming portion 21 primary-transfers a toner image onto an intermediate transfer belt 12 that is described below. The secondary transfer portion 14 secondary-transfers the toner image that has been temporarily transferred on the intermediate transfer belt 12, to a print sheet. The fixing portion 15 fixes, to the print sheet, the toner image that has been secondary-transferred to the print sheet.

The intermediate transfer unit 4 includes the intermediate transfer belt 12, a driving roller 12*a*, and a tension roller 12*b*. The intermediate transfer belt 12 is a belt having a shape of an endless loop and is made of rubber, urethane or other material. The intermediate transfer belt 12 is wound around the driving roller 12*a* and the tension roller 12*b*, and is run in the front direction Fr and in the opposite direction as the driving roller 12*a* is driven and rotated by a driving motor (not shown). The driving roller 12*a* is disposed close to the fixing portion 15 (on the right side in FIG. 1). The tension roller 12*b* is disposed away from the fixing portion 15 (on the left side in FIG. 1). The surface of the tension roller 12*b* is made of rubber, urethane or other material that increases friction force with the driving roller 12*a*.

The image forming apparatus 1 of the present embodiment is a so-called tandem color image forming apparatus, and includes a plurality of image forming portions 21. The plurality of image forming portions 21 are aligned in the left-right direction in FIG. 1. The plurality of image forming portions 21 form toner images of different colors, and in an order from the right in FIG. 1, an image forming portion for black, an image forming portion for cyan, an image forming portion for magenta, and an image forming portion for yellow are arranged in a row.

The image forming portions 21 form images using replenishing toner of a plurality of colors (Y, M, C, K) stored in a plurality of toner containers 20. Each of the image forming portions 21 includes a photoconductor drum 24, a charging portion 25, a cleaning unit 26, a developing portion 27, and a primary transfer roller 28. The photoconductor drum 24 carries a toner image. The charging portion 25 uniformly charges the surface of the photoconductor drum 24. The developing portion 27 develops an electrostatic latent image on the photoconductor drum 24 by using toner. The primary transfer roller 28 transfers the toner image from the surface of the rotating photoconductor drum 24 to a moving intermediate transfer belt 12. The cleaning unit 26 removes remaining waste toner from the surface of the photoconductor drum 24. An exposure portion 22 is provided below the image forming portion 21. The exposure portion 22 forms the electrostatic latent image by exposing the charged surface of the photoconductor drum 24 to scanning light. The toner containers 20 that are aligned below the sheet discharge tray 5 have been installed in the apparatus main body 2 each in an attachable/detachable manner.

In the image forming apparatus 1 having the above-described configuration, the surface of the photoconductor drum 24 is uniformly charged by the charging portion 25. The exposure portion 22 performs exposure on the photoconductor drum 24 based on image data. With this exposure, an electrostatic latent image is formed on the surface of the photoconductor drum 24. The developing portion 27 then visualizes the electrostatic latent image (forms a toner image) by using toner supplied from the toner containers 20.

When a bias is applied to the primary transfer roller 28, the toner image formed on the surface of the photoconductor drum 24 is transferred to the surface of the running intermediate transfer belt 12. The waste toner that has remained on the surface of the photoconductor drum 24 is removed by the cleaning unit 26. These operations are performed in the image forming portions 21 in sequence, and a color toner image is formed on the surface of the intermediate transfer belt 12.

On the other hand, the print sheet supplied by the sheet feed portion 11 from the sheet feed cassette 3 is passed through the conveyance path 10 and conveyed to the secondary transfer portion 14. When a bias is applied to the secondary transfer portion 14, the color toner image formed on the surface of the intermediate transfer belt 12 is secondary-transferred to the print sheet. Subsequently, the print sheet is subjected to a fixing process by the fixing portion 15, and is ejected onto the sheet discharge tray 5.

The photoconductor drum 24, charging portion 25, and cleaning unit 26 are provided as a unit. This unit is referred to as a drum unit 21*a*. The following explains a movement path of the waste toner removed from the photoconductor drum 24.

Figure 2:
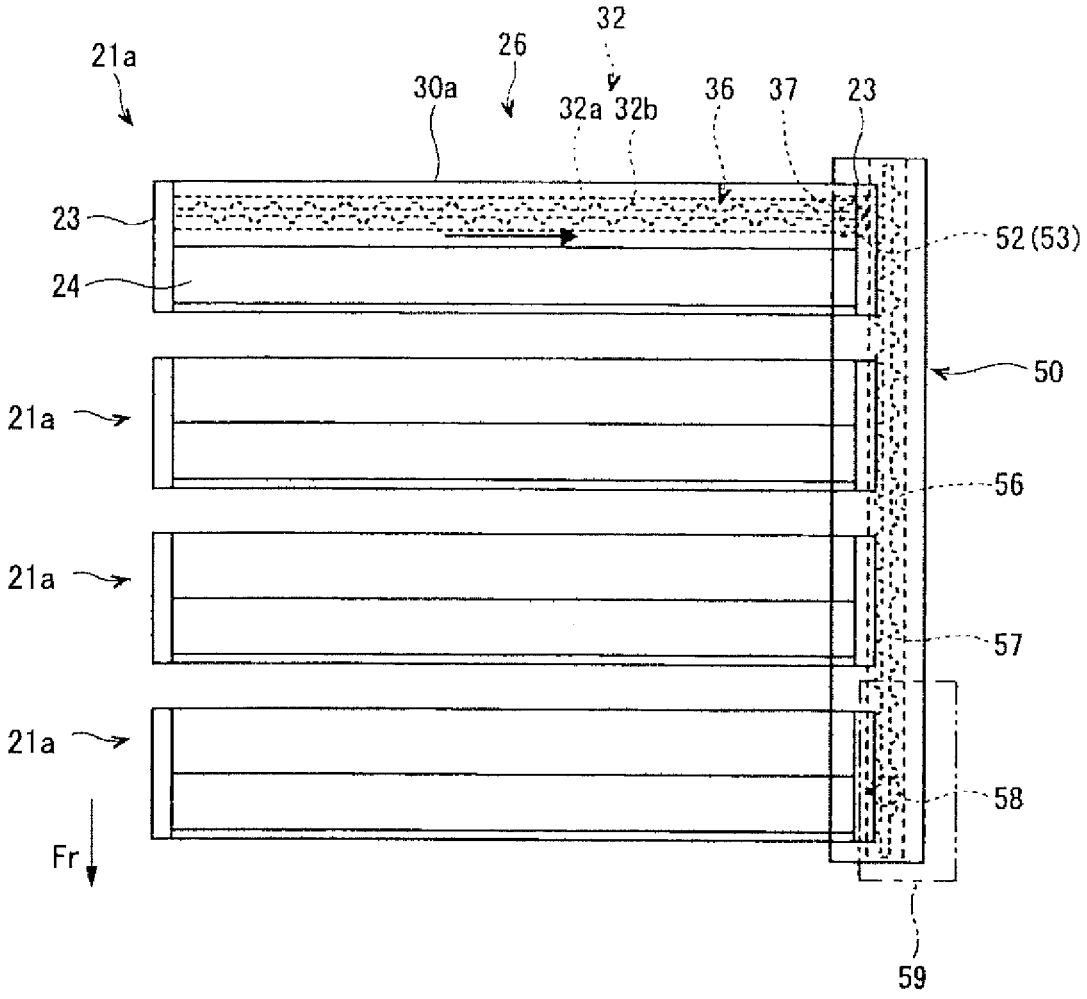
FIG. 2 is a schematic plan view showing the drum unit and the waste toner conveying device included in the image forming apparatus of FIG. 1.

As shown in FIG. 2, the waste toner removed from the photoconductor drum 24 in each drum unit 21*a* drops to a first conveyance path 36 (see FIG. 4) of each cleaning unit 26, the first conveyance path 36 being described below. The waste toner accumulated in the first conveyance path 36 is conveyed in the downstream direction toward a first opening 37 by the rotation of a first screw member 32 provided in a casing 30 (see FIG. 3) of the cleaning unit 26.

The image forming apparatus 1 includes a waste toner conveying device 50 that conveys, into a waste toner bottle 59, the waste toner that has been conveyed by the cleaning units 26. The waste toner conveying device 50 is configured to be connected with the cleaning units 26 that are arranged in the front-rear direction of the image forming apparatus 1.

In the waste toner conveying device 50, a second conveyance path 56 extends in the front-rear direction. The second conveyance path 56 includes inlets 53 for introducing the waste toner from the respective cleaning units 26. A second screw member 57 is disposed in the second conveyance path 56. The second screw member 57 has the same configuration as the first screw member 32. The opposite ends of the second screw member 57 in the axis direction are rotatably supported by the inner wall of the second conveyance path 56. The second screw member 57 is driven and rotated by a driving motor (not shown). A second outlet 58 is formed at a downstream-side end of the second conveyance path 56. The second outlet 58 communicates with the waste toner bottle 59. As described below, the image forming apparatus 1 of the present embodiment includes a shutter member 33 that, as described below, plays a role in the communication and blockage between the first conveyance path 36 in the cleaning unit 26 and the second conveyance path 56 in the waste toner conveying device 50. The following describes specific configuration of each portion.

Figure 3:
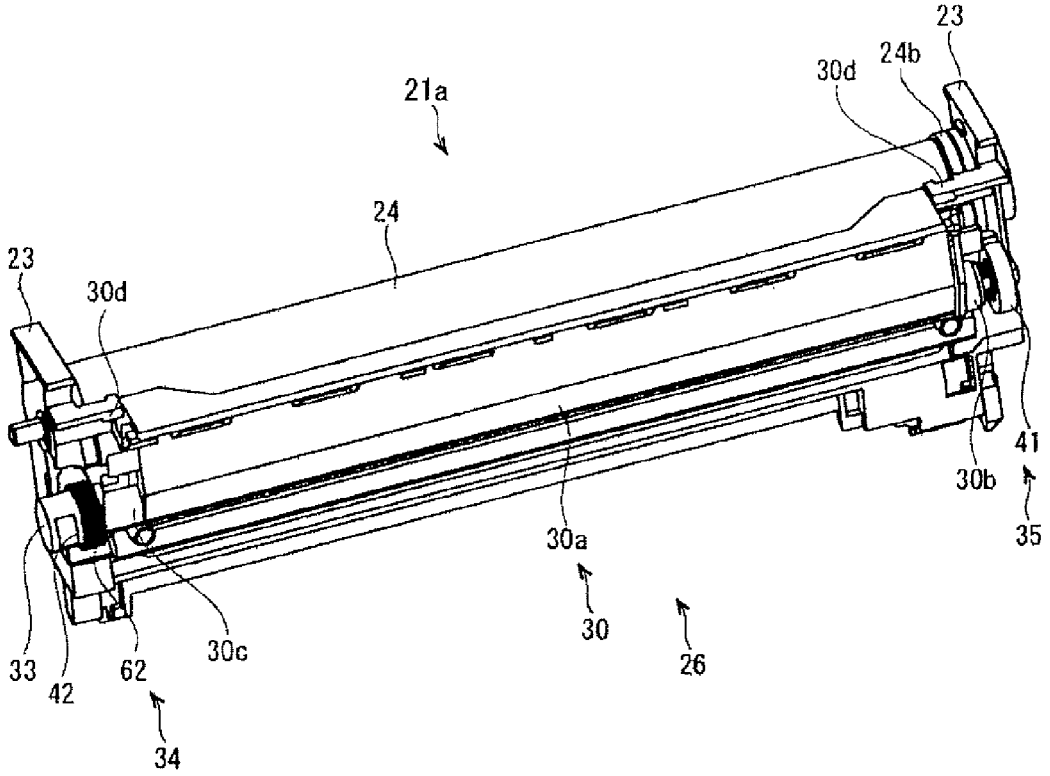
FIG. 3 is a perspective view showing the drum unit included in the image forming apparatus of FIG. 1.
Figure 4:
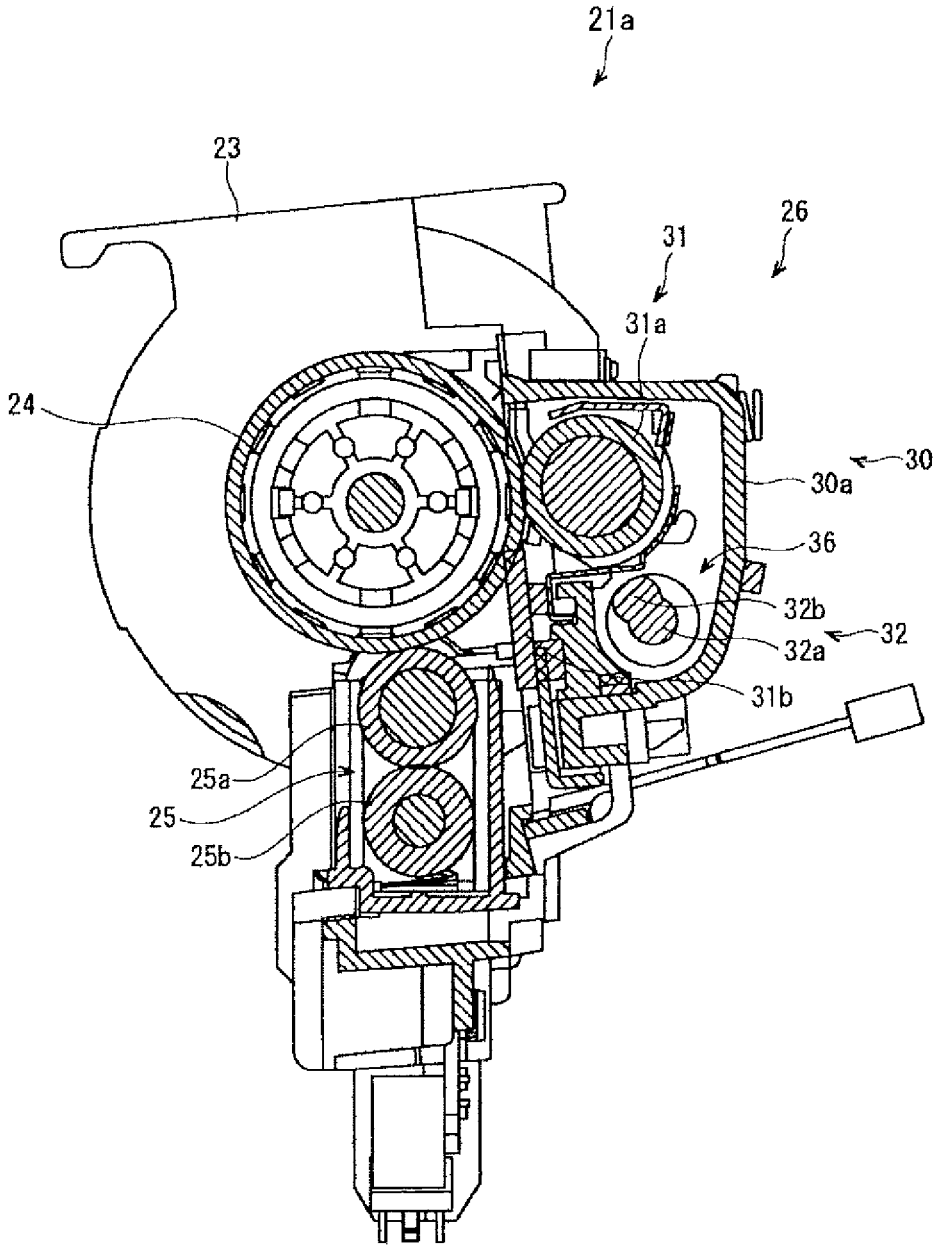
FIG. 4 is a cross sectional view showing the drum unit included in the image forming apparatus of FIG. 1.

As shown in FIGS. 3 and 4, the photoconductor drum 24 is rotatably supported by a pair of supporting frames 23 provided at the opposite ends of the drum unit 21*a* in the axis direction. A drum driving gear 24*b* is attached to an upstream-side end (the right end in FIG. 3) of the photoconductor drum 24, with a supporting frame 23 therebetween. The drum driving gear 24*b* meshes with a driving gear 29 that is driven and rotated by a driving motor (not shown) (see FIGS. 15A and 15B). When the drum driving gear 24*b* is driven by the driving motor, the photoconductor drum 24 is driven and rotated via the mesh of the drum driving gear 24*b* and the driving gear 29.

As shown in FIG. 4, the charging portion 25 includes a charging roller 25*a* and a rubbing roller 25*b*. The charging roller 25*a* slidably contacts the photoconductor drum 24. The rubbing roller 25*b* polishes the surface of the charging roller 25*a*.

As shown in FIGS. 3 and 4, the cleaning unit 26 includes the casing 30, a cleaning member 31, the first screw member 32, the shutter member 33, a shutter opening/closing mechanism 34, and a screw moving mechanism 35. Here, the cleaning unit 26 is an example of the toner conveying device of the present disclosure. More specifically, a second cylindrical portion 30*c* (described below), the shutter member 33, and the shutter opening/closing mechanism 34 that are included in the casing 30 configure the toner conveying device of the present disclosure.

The casing 30 supports the cleaning member 31 and the like. The casing 30 includes a casing main body 30*a*, a first cylindrical portion 30*b*, and the second cylindrical portion 30*c*. The casing main body 30*a* extends along the axis direction of the photoconductor drum 24, and has an opening on the photoconductor drum 24 side. As shown in FIG. 3, the casing main body 30*a* is shorter than the photoconductor drum 24 in length in the axis direction, and is supported by the supporting frames 23 via connecting arms 30*d* at the opposite ends of the drum unit 21*a*.

Figure 6:
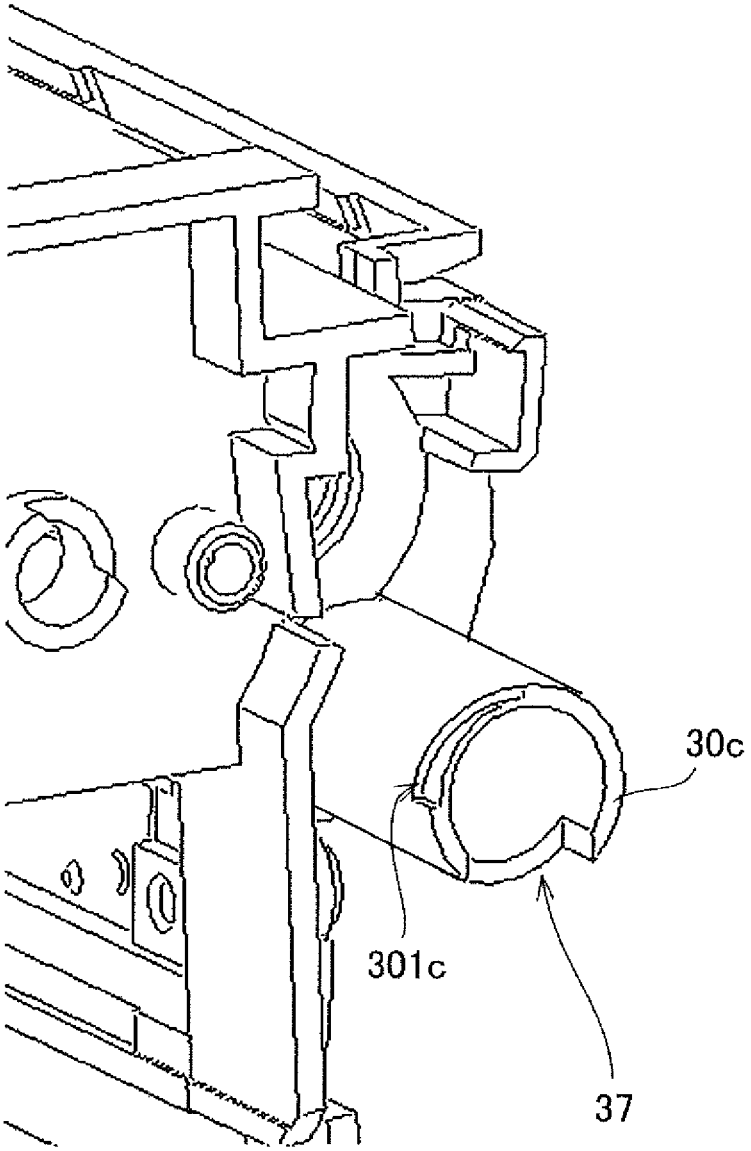
FIG. 6 is a perspective view of an external appearance showing the configuration of the second cylindrical portion among the components of the casing of the cleaning unit.
Figure 7:
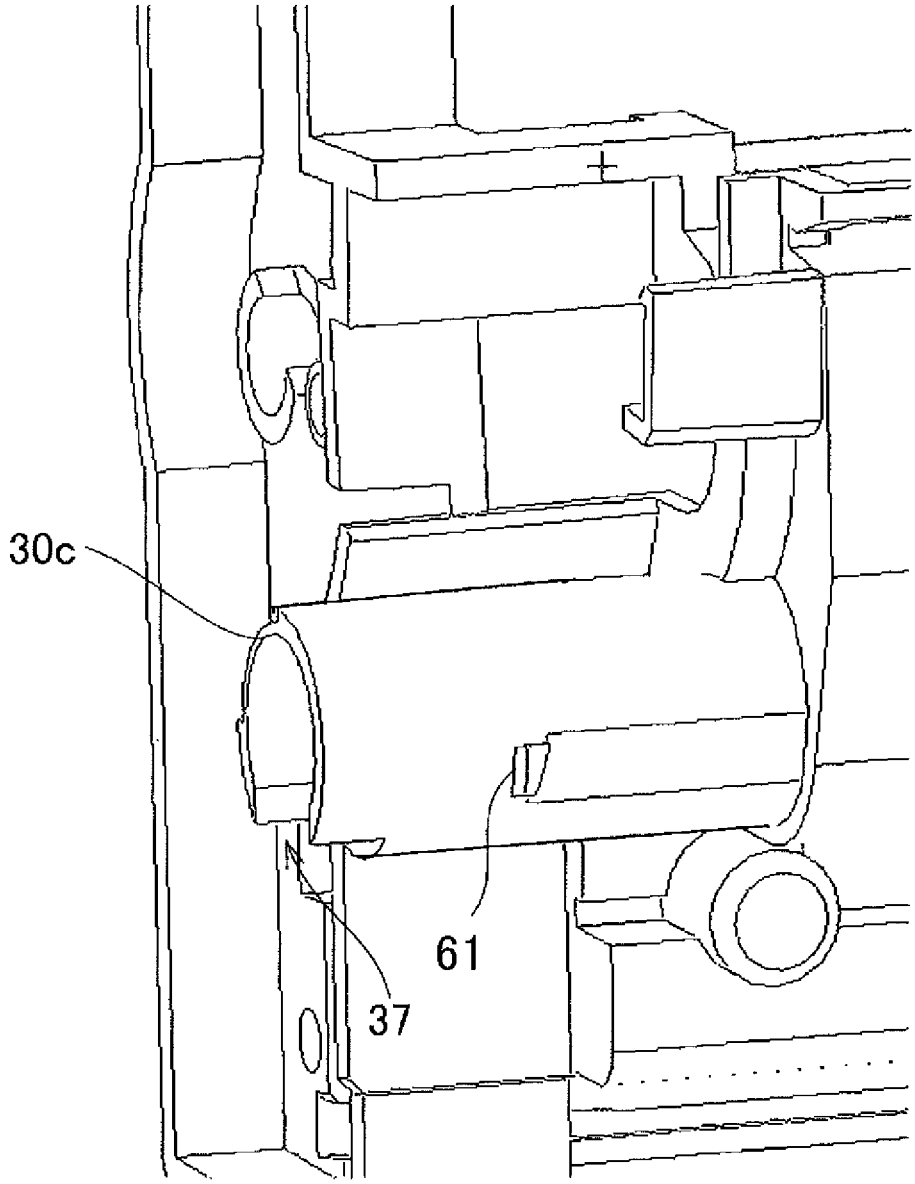
FIG. 7 is a perspective view of an external appearance showing the configuration of the second cylindrical portion seen in a different direction from FIG. 6.

The first cylindrical portion 30*b* and the second cylindrical portion 30*c* are each formed in the shape of a cylinder. The first cylindrical portion 30*b* projects outward from an upstream-side end (the right end in FIG. 3) of the casing main body 30*a*. The second cylindrical portion 30*c* projects outward from a downstream-side end (the left end in FIG. 3) of the casing main body 30*a*. As shown in FIGS. 6 and 7, a part of an end of the second cylindrical portion 30*c* is cut to form the first opening 37 that is communicable with the first conveyance path 36.

Figure 5:
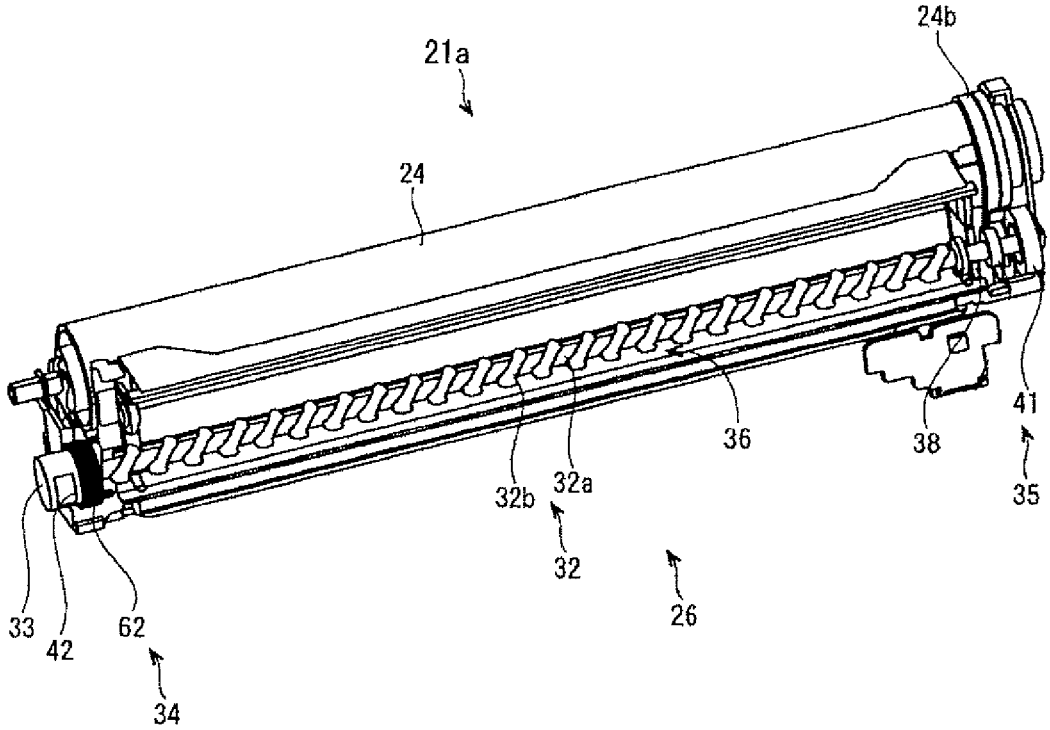
FIG. 5 is a cross sectional view showing the internal configuration of the cleaning unit included in the image forming apparatus of FIG. 1.

In addition, as shown in FIG. 6, a slant guide surface 301*c* is formed on an end of the second cylindrical portion 30*c* at a position different from the position of the cut in the circumferential direction, wherein the slant guide surface 301*c* is a slant surface that extends slanting with respect to the circumferential direction of the second cylindrical portion 30*c*. A slant portion 66 (described below) of the shutter member 33 slidably contacts the slant guide surface 301*c*. Upon the contact, the slant guide surface 301*c* guides the shutter member 33 to pivot around the axis and move in the axis direction. As shown in FIG. 7, a projection 61 is provided on an outer circumferential surface of the second cylindrical portion 30*c*. The second cylindrical portion 30*c* is an example of the cylindrical member. As shown in FIG. 5, the first conveyance path 36 for conveying the waste toner is defined by the first cylindrical portion 30*b*, casing main body 30*a*, and second cylindrical portion 30*c*.

As shown in FIGS. 3 and 4, the cleaning member 31 includes a cleaning roller 31*a* and a cleaning blade 31*b*.

The opposite ends of the cleaning roller 31*a* in the axis direction are rotatably supported by the casing main body 30*a*. A part of the circumferential surface of the cleaning roller 31*a* abuts on the surface of the photoconductor drum 24 via the opening of the casing 30. The cleaning roller 31*a* is driven and rotated by a driving motor (not shown) in an opposite direction to the photoconductor drum 24, thereby removing the waste toner that has remained on the surface of the photoconductor drum 24 after transferring of a toner image to the primary transfer roller 28.

The cleaning blade 31*b* is provided below the cleaning roller 31*a*. The cleaning blade 31*b* is made of urethane rubber or other material and is elastic. An upper part of the cleaning roller 31*a* is a free end and is elastically pressed against the surface of the photoconductor drum 24. With this configuration, the waste toner on the surface of the photoconductor drum 24 is scraped. In this way, the cleaning member 31 removes toner from the surface of the photoconductor drum 24 that carries the toner image.

As shown in FIGS. 4 and 5, the first screw member 32 conveys the waste toner in the first conveyance path 36 formed in the casing 30. The first screw member 32 includes a rotary shaft 32*a* and a helical vane 32*b*. The rotary shaft 32*a* extends along the first conveyance path 36. The helical vane 32*b* is helically formed on the circumferential surface of the rotary shaft 32*a*. The first screw member 32 passes through the first cylindrical portion 30*b* and extends toward the upstream side. A driven gear 41 (see FIG. 3) is attached to an upstream-side end of the first screw member 32.

Figure 8A:
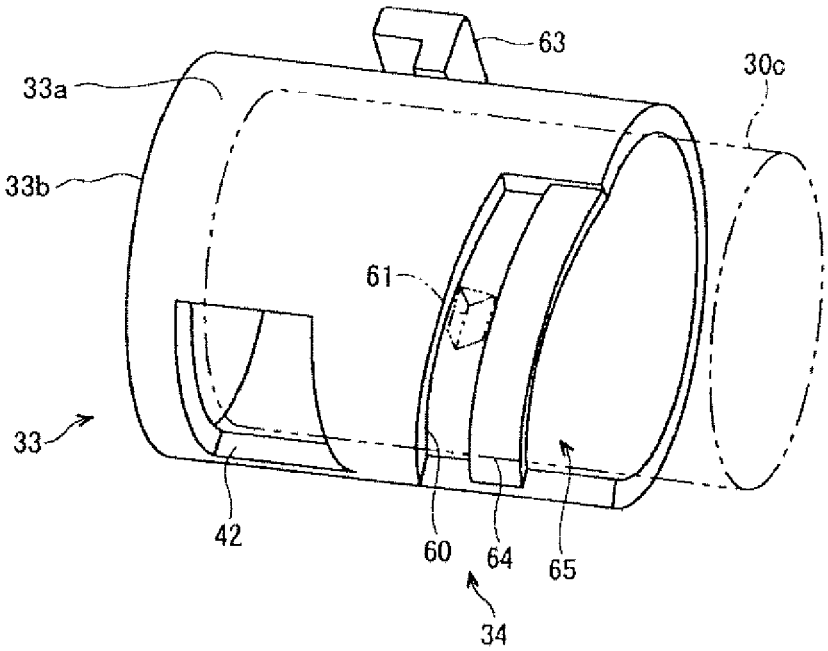
FIG. 8A is a perspective view, seen from a side, of the shutter member included in the cleaning unit of FIG. 5.
Figure 8B:
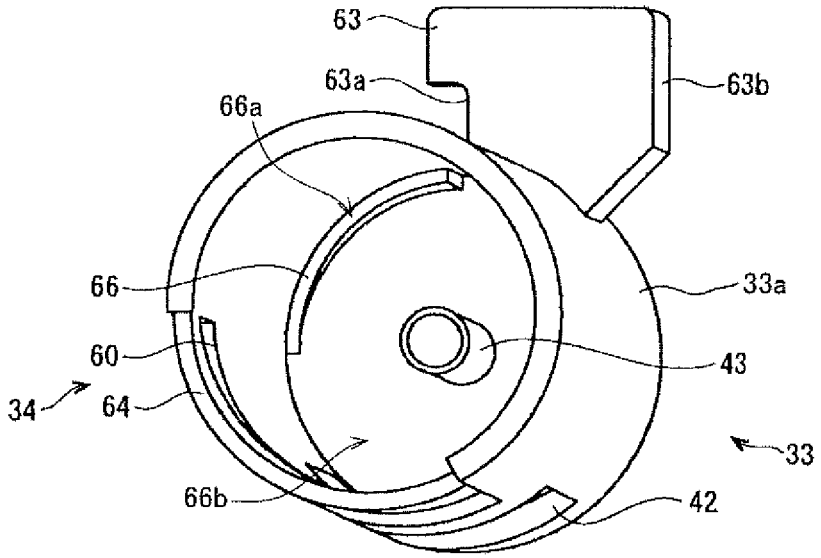
FIG. 8B is a perspective view thereof seen in the axis direction.
Figure 11A:
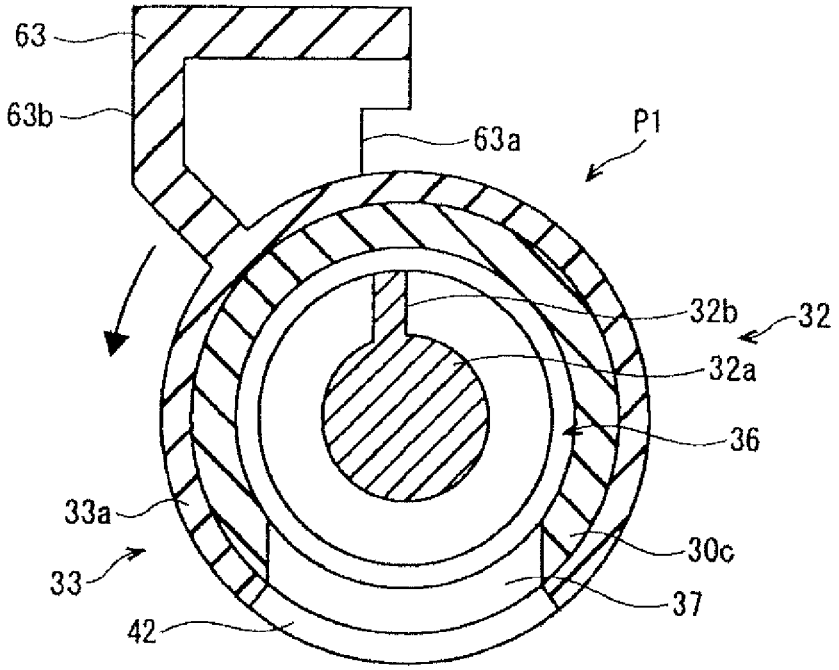
FIG. 11A is a cross sectional view of the peripheral of the shutter member when the shutter member is at the opening position.
Figure 11B:
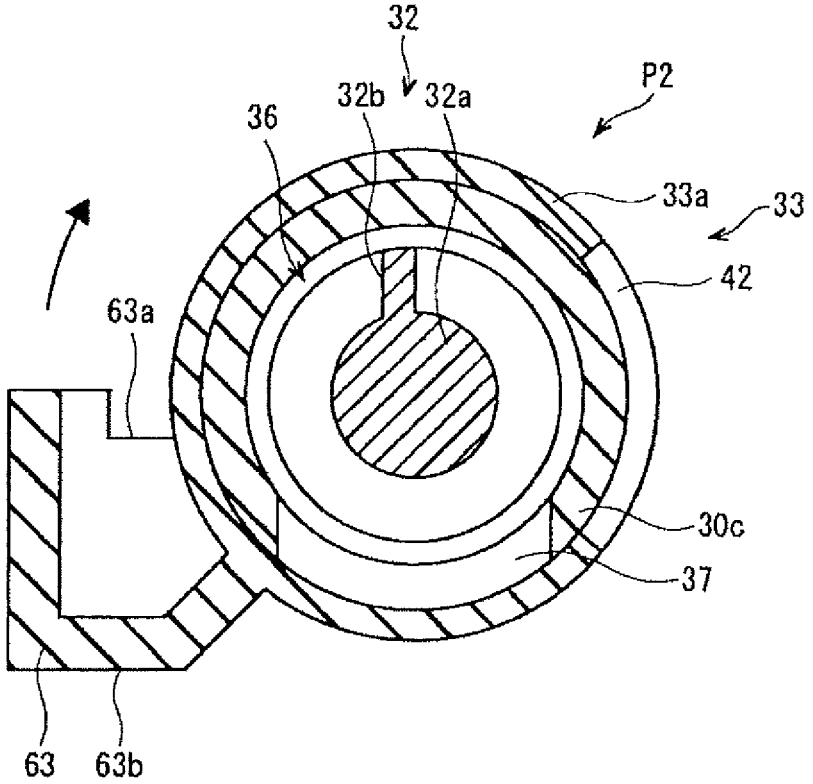
FIG. 11B is a cross sectional view of the peripheral of the shutter member when the shutter member is at the closing position.

As shown in FIGS. 8A and 8B, the shutter member 33 has a shape of a cylinder with a bottom, and is externally fitted with the second cylindrical portion 30*c* (see FIGS. 11A and 11B). The shutter member 33 opens and closes the first opening 37 of the second cylindrical portion 30*c*. A rectangular outlet 42 is formed in a circumferential wall 33*a* of the shutter member 33. As shown in FIG. 8B, a cylindrical downstream-side bearing 43 is formed on an inner surface 66*b* of a bottom wall 33*b* of the shutter member 33. The downstream-side bearing 43 rotatably supports a downstream-side end of the first screw member 32. The downstream-side bearing 43 projects toward the upstream side in the axis direction from the center of the inner surface of the shutter member 33, and is fitted with the rotary shaft 32*a* of the first screw member 32 in an insertable/removable manner. It is noted that, as shown in FIGS. 3 and 5, an upstream-side bearing 38 is formed at a part where the casing main body 30*a* is connected with the first cylindrical portion 30*b*, and the upstream-side bearing 38 rotatably supports an upstream-side end of the first screw member 32. As a result, the opposite ends of the first screw member 32 are pivotally supported by the upstream-side bearing 38 and the downstream-side bearing 43 of the shutter member 33.

The circumferential wall 33*a* of the shutter member 33 includes a second opening 60 and a lever 63.

The second opening 60 is formed at an upstream of the outlet 42 on the circumferential wall 33*a* of the shutter member 33. The second opening 60 extends slanting with respect to the circumferential direction of the circumferential wall 33*a*. In addition, the second opening 60 is formed in a rectangular shape of the same width that slants such that it goes away from the bottom wall 33*b* of the shutter member 33 as it goes toward the upstream side. The second opening 60 is engaged with the projection 61 of the second cylindrical portion 30*c*. The projection 61 relatively moves in the second opening 60 as the shutter member 33 rotates around the axis. The engagement of the second opening 60 and the projection 61 of the second cylindrical portion 30*c* prevents the shutter member 33 from dropping off from the second cylindrical portion 30*c* in movement in the axis direction.

A thin wall 64 is formed adjacent to the second opening 60, defining the upstream side of the second opening 60, wherein the thin wall 64 is slightly thinner than the circumferential wall 33*a* of the shutter member 33. The thin wall 64 has approximately the same width as the second opening 60. A cut 65 is formed slantly along the thin wall 64 on the opening side of the shutter member 33.

In addition, as shown in FIG. 8B, a slant portion 66 is formed on the inner surface 66*b* of the bottom wall 33*b* of the shutter member 33. The slant portion 66 includes a slant surface 66*a* that is slanted in the same direction and at the same angle as the second opening 60 with respect to the circumferential direction of the circumferential wall 33*a*. The slant portion 66 is formed at a position that is different from the position of the second opening 60 in the circumferential direction. The slant portion 66 abuts on the slant guide surface 301*c* of the second cylindrical portion 30*c*, and slidably contacts the slant guide surface 301*c* when the shutter member 33 rotates around the axis.

As described above, in the present embodiment, the shutter member 33's rotation around the axis and movement in the axis direction are guided by the abutment of the slant portion 66 of the shutter member 33 and the slant guide surface 301*c* of the second cylindrical portion 30*c*, and by the engagement of the second opening 60 with the projection 61 of the second cylindrical portion 30*c*.

As shown in FIG. 8B, the lever 63 projects from the outer circumferential surface of the circumferential wall 33*a*. In the lever 63, a locking portion 63*a* is formed as a recess that is recessed in the circumferential direction. An end of a coil spring 62 that is described below is locked to the locking portion 63*a*. In addition, a part of the lever 63 opposite to the locking portion 63*a* is a flat abutting portion 63*b*. When the cleaning unit 26 is installed in the image forming apparatus 1, the abutting portion 63*b* contacts a lever engaging portion 55 (an example of the predetermined contact portion on the image forming apparatus 1 side), and thereby receives an external force that allows the shutter member 33 to pivot from a closed position P2 to an open position P1.

As shown in FIG. 5, the image forming apparatus 1 of the present embodiment is provided with the shutter opening/closing mechanism 34.

Figure 9:
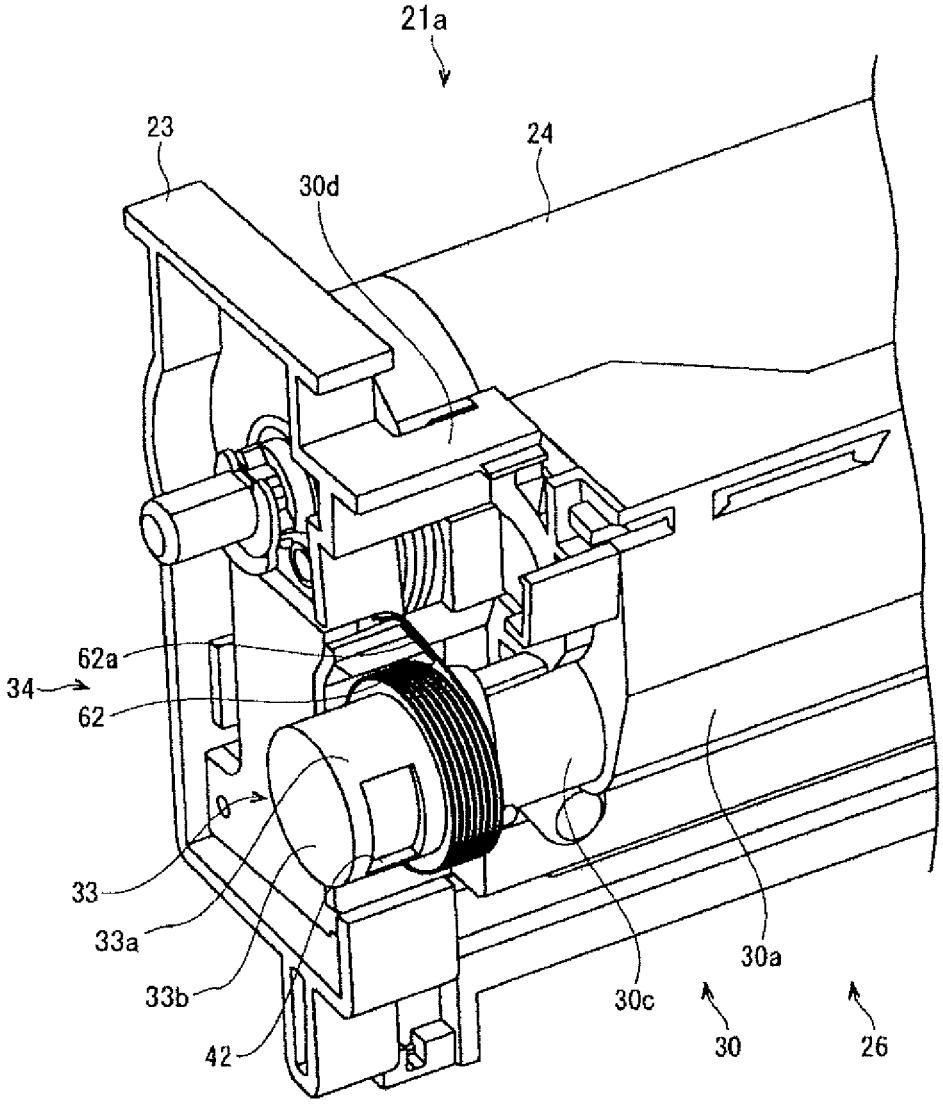
FIG. 9 is a perspective view of a part of the shutter opening/closing mechanism included in the cleaning unit of FIG. 5.

As shown in FIG. 9, the shutter opening/closing mechanism 34 is composed of the second opening 60 and the lever 63 formed on the circumferential wall 33*a* of the shutter member 33, and the projection 61 and the coil spring 62 formed on the second cylindrical portion 30*c*.

Figure 10A:
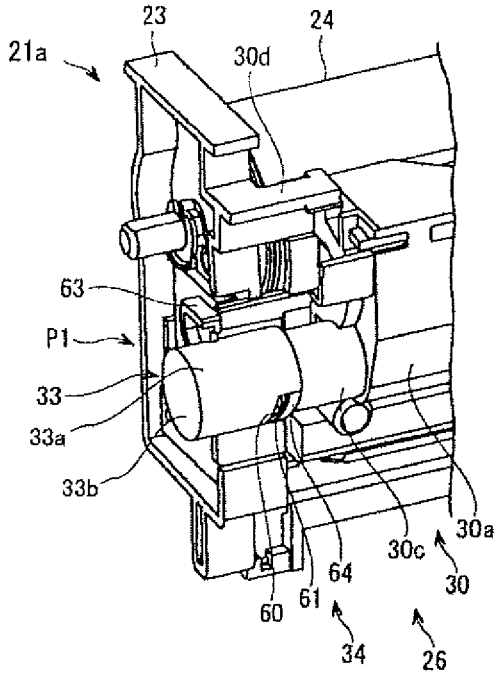
FIG. 10A is a perspective view of the peripheral of the shutter member when the shutter member is at an opening position.
Figure 10B:
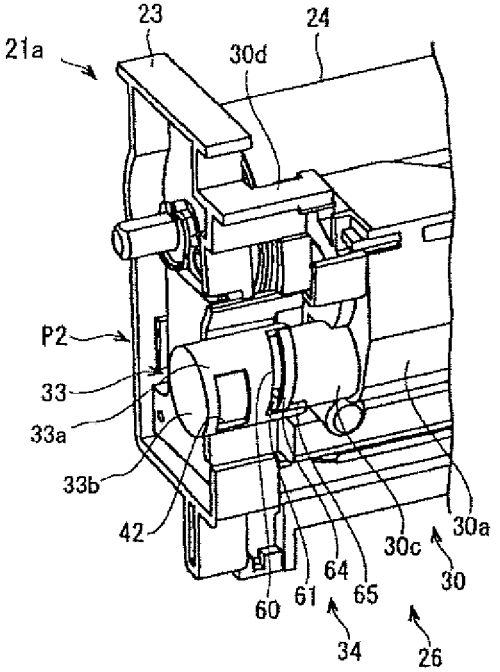
FIG. 10B is a perspective view of the peripheral of the shutter member when the shutter member of FIG. 8 is at a closing position.
Figure 12A:
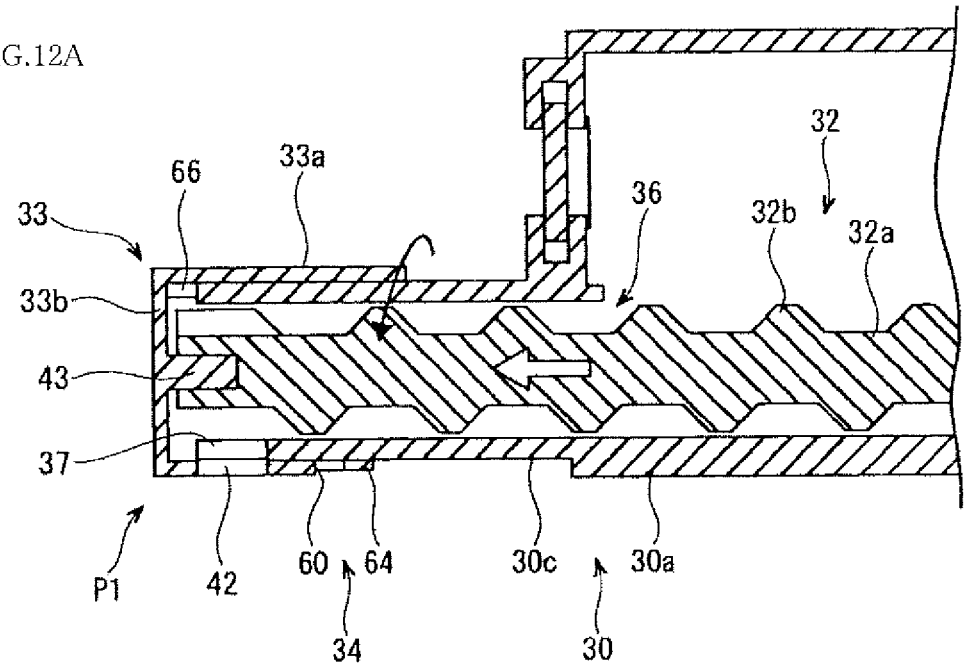
FIGS. 12A and 12B are operation explanatory diagrams of the shutter opening/closing mechanism.
Figure 12B:
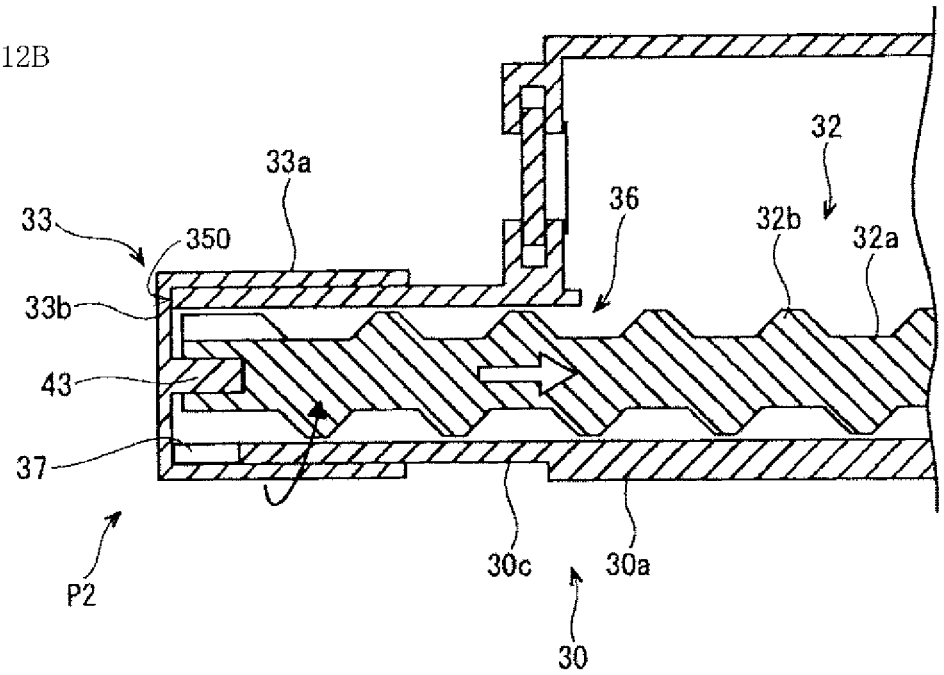

The shutter opening/closing mechanism 34 moves the shutter member 33 in the axis direction between the open position P1 and the closed position P2. The open position P1, is shown in FIGS. 10A, 11A and 12A, and the closed position P2, is shown in FIGS. 10B, 11B and 12B. When the shutter member 33 is at the open position P1, the outlet 42 of the shutter member 33 and the first opening 37 of the second cylindrical portion 30*c* overlap with each other, and the first opening 37 communicates with the second conveyance path 56. When the shutter member 33 is at the closed position P2, the outlet 42 of the shutter member 33 and the first opening 37 of the second cylindrical portion 30*c* are at different positions, and the first opening 37 is closed by the shutter member 33.

The second opening 60 formed in the shutter member 33 is engaged with the projection 61 formed on the second cylindrical portion 30*c*. In addition, the slant portion 66 of the shutter member 33 abuts on the slant guide surface 301*c* formed at the downstream-side end of the second cylindrical portion 30*c*. As a result, the movement of the shutter member 33 in the axis direction between the open position P1 and the closed position P2 involves a rotation around the axis. In addition, the closed position P2 is on the upstream side of the open position P1 in the axis direction.

As described above, the shutter opening/closing mechanism 34 allows the shutter member 33 to pivot between the open position P1 for the first opening 37 to be opened and the closed position P2 for the first opening 37 to be closed, while allowing the shutter member 33 to move in a direction along an axis around which the shutter member 33 pivots.

Meanwhile, the following problem occurs when such configuration of the shutter member 33 is adopted. That is, a predetermined gap is provided between the inner circumferential surface of the shutter member 33 and the outer circumferential surface of the second cylindrical portion 30*c* to ensure a smooth rotation of the shutter member 33 with respect to the second cylindrical portion 30*c*. As a result, when the cleaning unit 26 is removed from the apparatus main body 2, the waste toner may leak outside from the gap between the shutter member 33 and the end of the casing 30.

As shown in FIG. 9, the coil spring 62 functions as a biasing member that biases the shutter member 33 and dislocates the shutter member 33 from the open position P1 to the closed position P2 in the pivoting direction. The coil spring 62 is wound around the shutter member 33, covering the second opening 60 as a prevention of waste toner leakage. An end 62*a* of the coil spring 62 is locked to a supporting frame 23 on the downstream side, and the other end of the coil spring 62 is locked to the lever 63 of the shutter member 33. With this configuration, the coil spring 62 biases the shutter member 33 toward the closed position P2 in the pivoting direction, namely, in the counterclockwise direction in FIGS. 11A and 11B.

Figure 13:
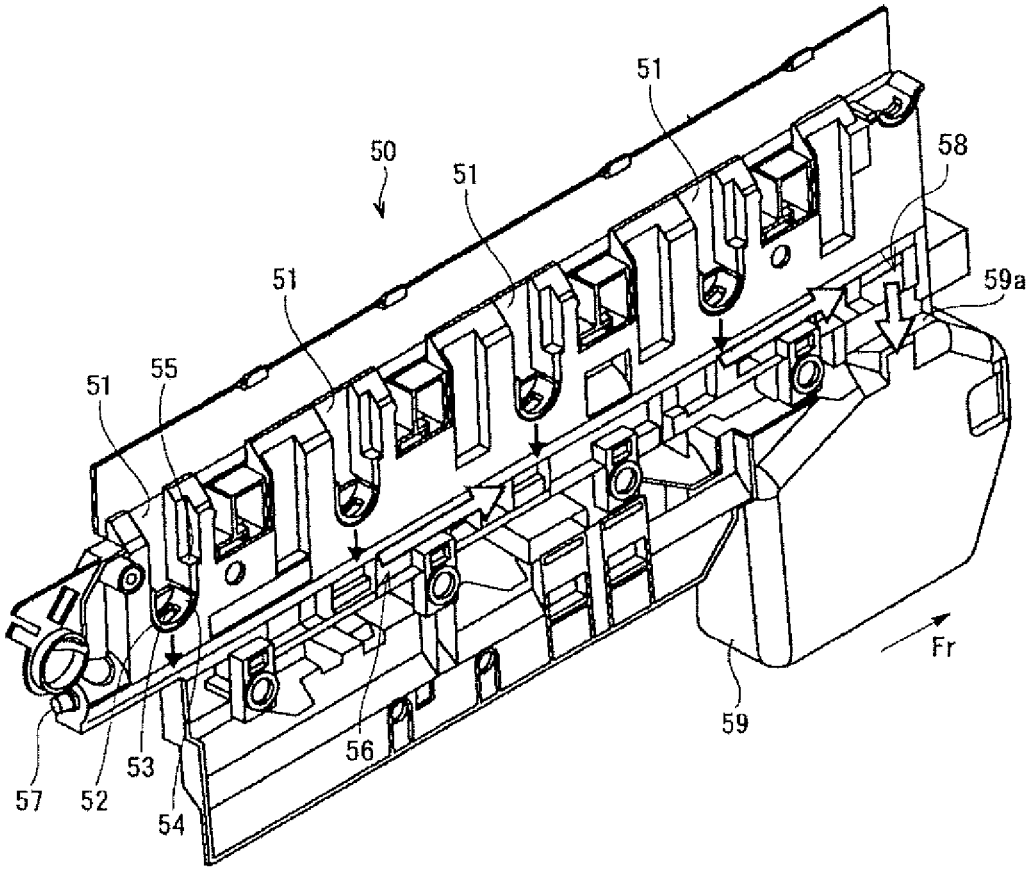
FIG. 13 is a perspective view of the waste toner conveying device and the waste toner bottle included in the image forming apparatus of FIG. 1.

As shown in FIG. 13, a plurality of unit connection grooves 51 are formed on the waste toner conveying device 50 at equal intervals. The first openings 37 of the cleaning units 26 are respectively connected to the plurality of unit connection grooves 51. Each unit connection groove 51 has a similar configuration to each other, extending from above to below. The shutter member 33 of each cleaning unit 26 is inserted to each unit connection groove 51 from above.

A unit reception portion 52 is formed on the bottom of each unit connection groove 51, the unit reception portion 52 having a shape that corresponds to the shape of the shutter member 33. The rectangular inlet 53 is formed in the unit reception portion 52. When the cleaning unit 26 is attached to the waste toner conveying device 50, the outlet 42 formed on the shutter member 33 allows the first opening 37 of the second cylindrical portion 30*c* to communicate with the inlet 53 of the unit reception portion 52 (see FIG. 14B).

The portion of the unit reception portion 52 other than the inlet 53 is composed of a seal 54 that is made of an elastic material such as synthetic rubber. When the cleaning unit 26 is attached to the waste toner conveying device 50, lower parts of the circumferential wall 33*a* and the bottom wall 33*b* including the rim of the outlet 42 of the shutter member 33 are sealed by the seal 54.

As shown in FIG. 13, a lever engaging portion 55 is formed on a side of each unit connection groove 51. The lever engaging portion 55 is provided on an upper part of the unit reception portion 52. When the cleaning unit 26 is attached to the waste toner conveying device 50, the cleaning unit 26 is temporarily engaged with the lever 63 provided on the circumferential wall 33*a* of the shutter member 33.

As the first screw member 32 rotates, the waste toner is conveyed in the downstream direction toward the first opening 37 and the outlet 42, passes the inlet 53 that is connected with the outlet 42 via the seal 54, and flows into the second conveyance path 56 (see the arrows in FIG. 13). Furthermore, as the second screw member 57 rotates, the waste toner having flown into the second conveyance path 56 is conveyed toward the second outlet 58 on the downstream side, passes through a recovery port 59*a* that communicates with the second outlet 58, and is recovered into the waste toner bottle 59 (see the white arrows in FIG. 13).

As shown in FIG. 5, the screw moving mechanism 35 is provided at an end of the cleaning unit 26 opposite to the shutter opening/closing mechanism 34, and moves the first screw member 32 in the same direction (the axis direction) as the shutter member 33 in conjunction with the movement of the shutter member 33 by the shutter opening/closing mechanism 34.

As shown in FIGS. 15A through 16B, the screw moving mechanism 35 includes the driving gear 29, the driven gear 41, and the coil spring 62 (see FIG. 9). The driving gear 29 rotates the photoconductor drum 24 via the drum driving gear 24*b* (see FIG. 3). The driven gear 41 meshes the driving gear 29 and rotates the first screw member 32. The driving gear 29 and the driven gear 41 are helical gears.

Figure 15A:
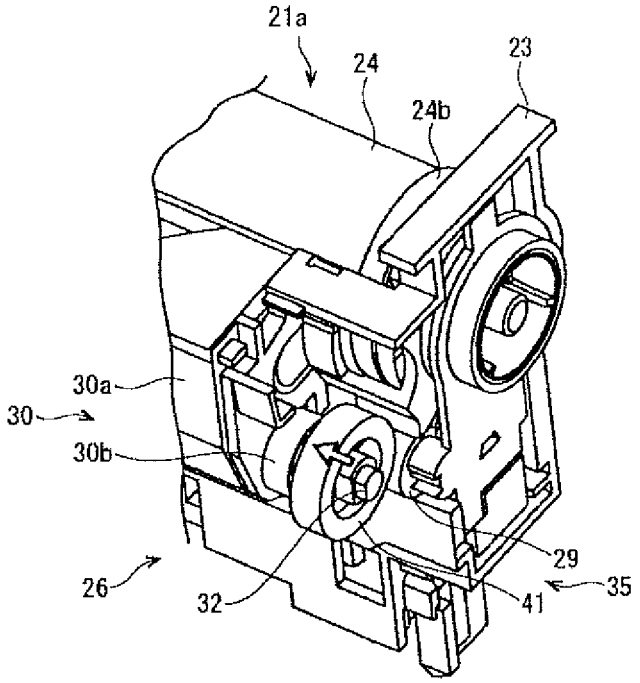
FIGS. 15A and 15B are operation explanatory diagrams of the screw moving mechanism included in the cleaning unit of FIG. 5.

When the driving motor (not shown) is driven to rotate the driving gear 29, thrust load toward the downstream (the left side in FIG. 13) acts on the driven gear 41 meshing with the driving gear 29. Upon receiving this, the driven gear 41 causes the thrust load to act on the first screw member 32 so that the shutter member 33 is moved to the open position P1. As a result, as shown in FIGS. 11A, 12A and 15A, the first screw member 32 moves toward the downstream side in the axis direction.

Figure 15B:
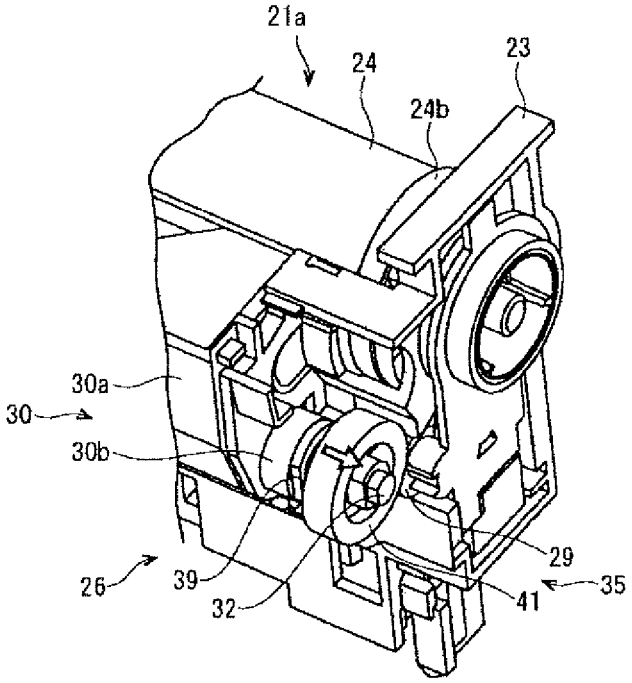
Figure 16A:
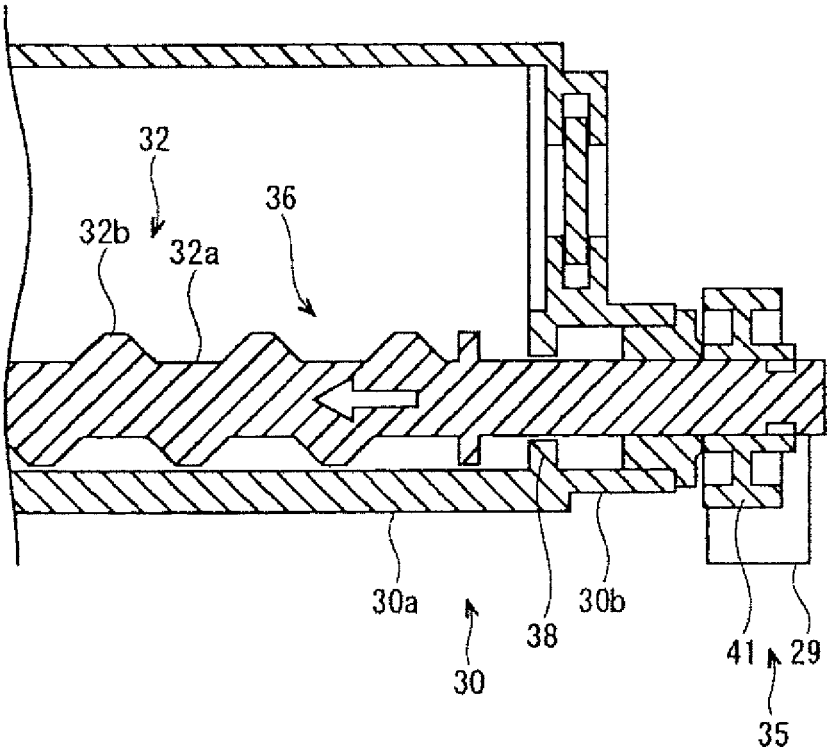
FIGS. 16A and 16B are operation explanatory diagrams of the screw moving mechanism included in the cleaning unit of FIG. 5.
Figure 16B:
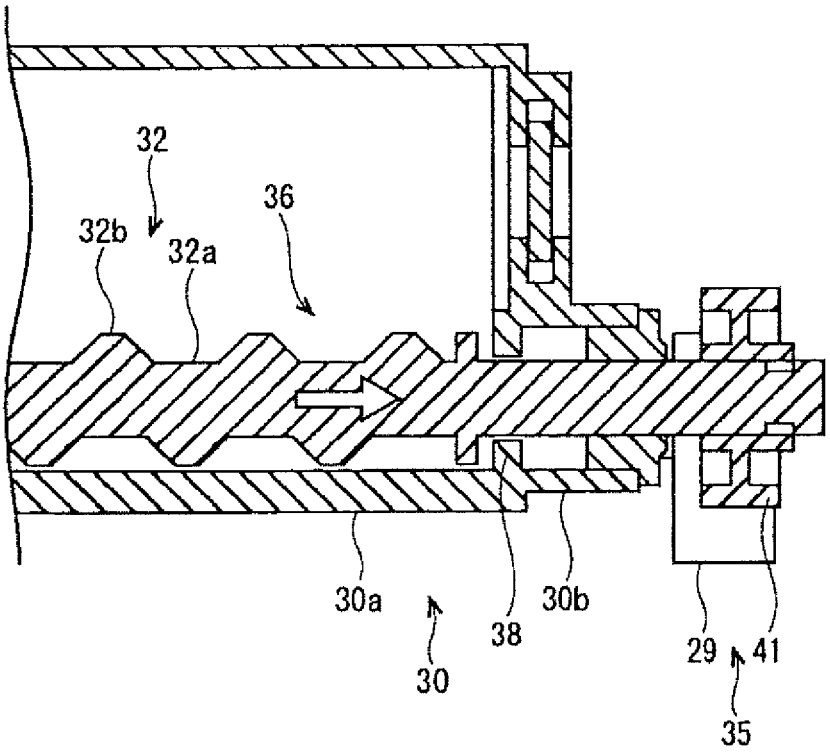

When the driving force is not acting on the driving gear 29, the thrust load does not occur, and as shown in FIGS. 15B and 16B, the first screw member 32 is in the state where it can move toward the upstream side in the axis direction together with the shutter member 33 by the biasing force of the coil spring 62.

When a drum unit 21*a* is attached to the apparatus main body 2, the apparatus main body 2 is opened and the unit connection grooves 51 of the waste toner conveying device 50 are exposed, and the shutter member 33 of the cleaning unit 26 is entered (inserted) into a corresponding unit connection groove 51 in a direction from above to below.

Figure 14A:
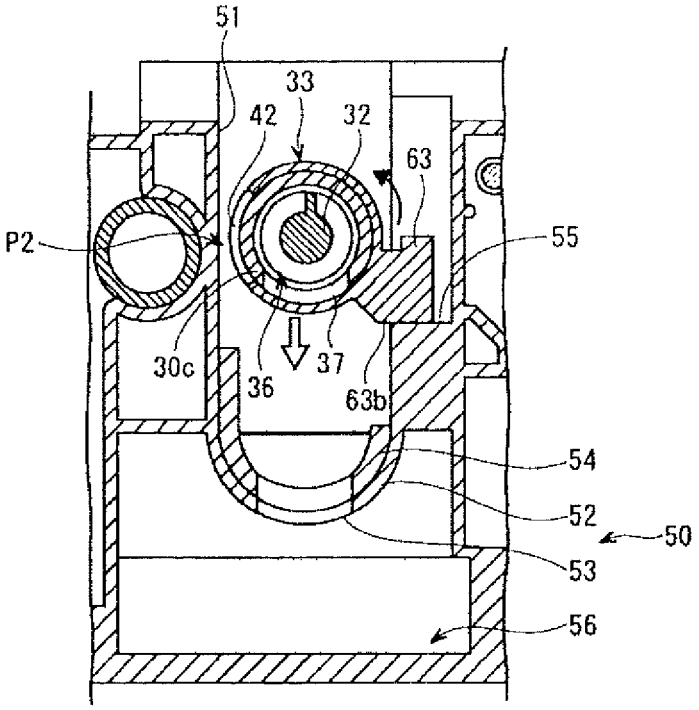
FIGS. 14A and 14B are explanatory diagrams of the action of the shutter opening/closing mechanism when the cleaning unit of FIG. 5 is attached and detached.

As the entering of the shutter member 33 into the unit connection groove 51 proceeds, the levers 63 of the shutter member 33 abuts on the lever engaging portions 55 of the unit connection groove 51 (see FIG. 14A). As the shutter member 33 further enters, the lever 63 abutting on the lever engaging portion 55 causes the shutter member 33 to rotate against the biasing force of the coil spring 62. At this time, the shutter member 33 is guided by the projection 61 engaged with the second opening 60, the slant portion 66, and the slant guide surface 301*c* to pivot counterclockwise in FIGS. 14A and 14B, while being slided toward the downstream side in the axis direction (see FIG. 14B).

Figure 14B:
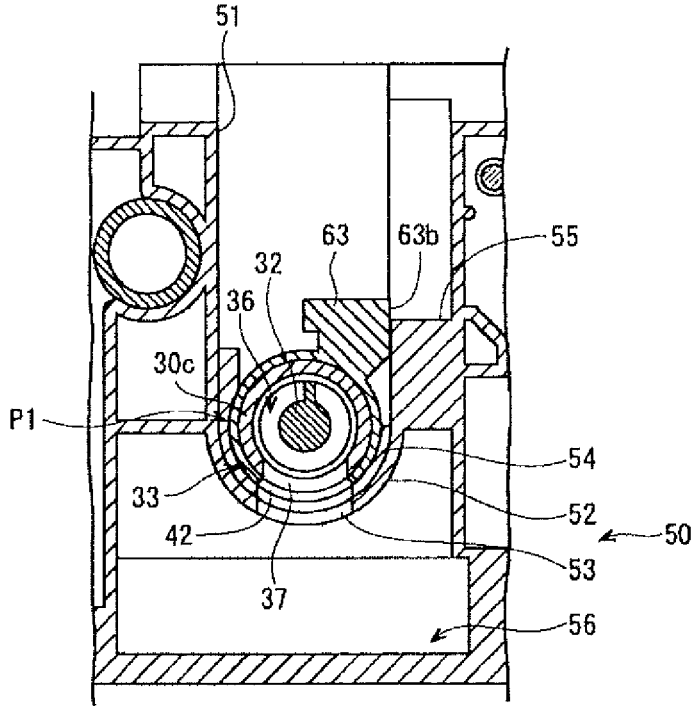

When the shutter member 33 reaches the unit reception portion 52, the outlet 42 of the shutter member 33 allows the first opening 37 of the second cylindrical portion 30*c* to be communicated with the inlet 53 of the unit reception portion 52 (see FIG. 14B). As this time, the shutter member 33 has moved to the open position P1.

On the other hand, when the drum unit 21*a* connected to the waste toner conveying device 50 is pulled upward, the shutter member 33 is dislocated upward along the unit connection groove 51. As the upward dislocation of the shutter member 33 proceeds, the shutter member 33 pivots in the opposite direction to the attachment direction by the biasing force of the coil spring 62. That is, by being guided by the second opening 60 and the slant portion 66, the shutter member 33 pivots (clockwise in FIGS. 14A and 14B), while being slided toward the upstream side in the waste toner conveyance direction (see FIG. 14A).

Here, in the present embodiment, as shown in FIGS. 12A and 12B, the movement of the shutter member 33 from the open position P1 to the closed position P2 by the biasing force of the coil spring 62 is not stopped in an engaged state due to the projection 61 abutting on the end of the second opening 60, but is stopped in an engaged state due to the bottom surface of the shutter member 33 abutting on an end (side edge) 350 of the second cylindrical portion 30*c*.

That is, when the shutter member 33 is at the closed position P2, the bottom surface of the shutter member 33 and the end (side edge) 350 of the second cylindrical portion 30*c* are pressed against each other by the shutter opening/closing mechanism 34. This causes the end 350 of the second cylindrical portion 30*c* to be in close contact with and closed by the bottom surface of the shutter member 33.

As a result, even if a gap exists between the shutter member 33 and the second cylindrical portion 30*c* that are fitted with each other, it is possible, when the drum unit 21*a* is removed from the image forming apparatus 1, to prevent the waste toner that has remained in the casing 30 from leaking outside from the gap. As a result, for example, there is no need to provide a seal member between the shutter member 33 and the second cylindrical portion 30*c*, thereby enabling the number of parts to be reduced.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner conveying device comprising:

a cylindrical member provided at an end of a toner conveyance path in which toner is conveyed, the cylindrical member having a first opening from which the toner is discharged, the end of the toner conveyance path being on a downstream side in a toner conveyance direction;

a shutter member formed in a shape of a cylinder with a bottom and configured to be externally fitted with the cylindrical member and open and close the first opening; and a shutter opening/closing mechanism configured to cause the shutter member to pivot between an open position at which the first opening is opened and a closed position at which the first opening is closed, while moving the shutter member in a direction along an axis around which the shutter member pivots such that at the closed position, a bottom surface of the shutter member and a side edge of the cylindrical member are pressed against each other.

2. The toner conveying device according to claim 1, wherein the shutter opening/closing mechanism includes a biasing member configured to bias the shutter member from the open position to the closed position, and the movement of the shutter member from the open position to the closed position by a biasing force of the biasing member is stopped in an engaged state by the side edge of the cylindrical member, thereby at the closed position, the bottom surface of the shutter member is pressed against the side edge of the cylindrical member.

3. The toner conveying device according to claim 2, wherein the shutter opening/closing mechanism further includes a second opening and a projection, the second opening being provided on an outer circumferential surface of the shutter member and slanting with respect to a circumferential direction of the shutter member, the projection being provided on an outer circumferential surface of the cylindrical member and configured to be engaged with the second opening, and the biasing member biases the shutter member to dislocate the shutter member from the open position to the closed position in the direction along the axis around which the shutter member pivots.

4. The toner conveying device according to claim 3, wherein the shutter opening/closing mechanism further includes a lever that projects from the outer circumferential surface of the shutter member, and when a cleaning device is attached to an image forming apparatus, contacts a predetermined contact portion on the image forming apparatus side, and thereby receives an external force that allows the shutter member to pivot from the closed position to the open position.

5. An image forming apparatus comprising:

a cleaning member configured to remove toner from a surface of a photoconductor drum that carries a toner image;

a cylindrical member provided at an end of a waste toner conveyance path in which waste toner removed by the cleaning member is conveyed, the cylindrical member having a first opening from which the toner is discharged, the end of the waste toner conveyance path being on a downstream side in a waste toner conveyance direction;

a shutter member formed in a shape of a cylinder with a bottom and configured to be externally fitted with the cylindrical member and open and close the first opening; and a shutter opening/closing mechanism configured to cause the shutter member to pivot between an open position at which the first opening is opened and a closed position at which the first opening is closed, while moving the shutter member in a direction along an axis around which the shutter member pivots such that at the closed state, a bottom surface of the shutter member and a side edge of the cylindrical member are pressed against each other.

* * * * *